US006600454B1

(12) United States Patent
Moilanen

(10) Patent No.: US 6,600,454 B1
(45) Date of Patent: Jul. 29, 2003

(54) ANTENNA RADIATOR

(75) Inventor: Mikko Moilanen, Halikko (FI)

(73) Assignee: Nokia Networks Oy, Espoo (FI)

( * ) Notice: Subject to any disclaimer, the term of this patent is extended or adjusted under 35 U.S.C. 154(b) by 0 days.

(21) Appl. No.: 09/913,953

(22) PCT Filed: Feb. 22, 2000

(86) PCT No.: PCT/FI00/00139

§ 371 (c)(1),
(2), (4) Date: Aug. 21, 2001

(87) PCT Pub. No.: WO00/51203

PCT Pub. Date: Aug. 31, 2000

(30) Foreign Application Priority Data

Feb. 24, 1999 (FI) ..... 990396

(51) Int. Cl.[7] ..... H01Q 9/16
(52) U.S. Cl. ..... 343/795; 343/793

(58) Field of Search ..... 343/795, 793, 343/878

(56) References Cited

U.S. PATENT DOCUMENTS 5,293,175 A 3/1994 Hemmie et al. ..... 343/795
5,691,735 A * 11/1997 Butland et al. ..... 343/795

FOREIGN PATENT DOCUMENTS

EP 889 543 1/1999

* cited by examiner

*Primary Examiner*—Don Wong
*Assistant Examiner*—James Clinger
(74) *Attorney, Agent, or Firm*—Pillsbury Winthrop LLP

(57) ABSTRACT

Antenna radiator, consisting of two plate-like or film-like parts (1, 2) connected by their foot ends (11) to each other and to the supply connection of the antenna. To reduce especially current and voltage losses, the radiator parts are substantially wider at the foot (1) than at the tip (12).

5 Claims, 1 Drawing Sheet

ANTENNA RADIATOR

Figure 1:
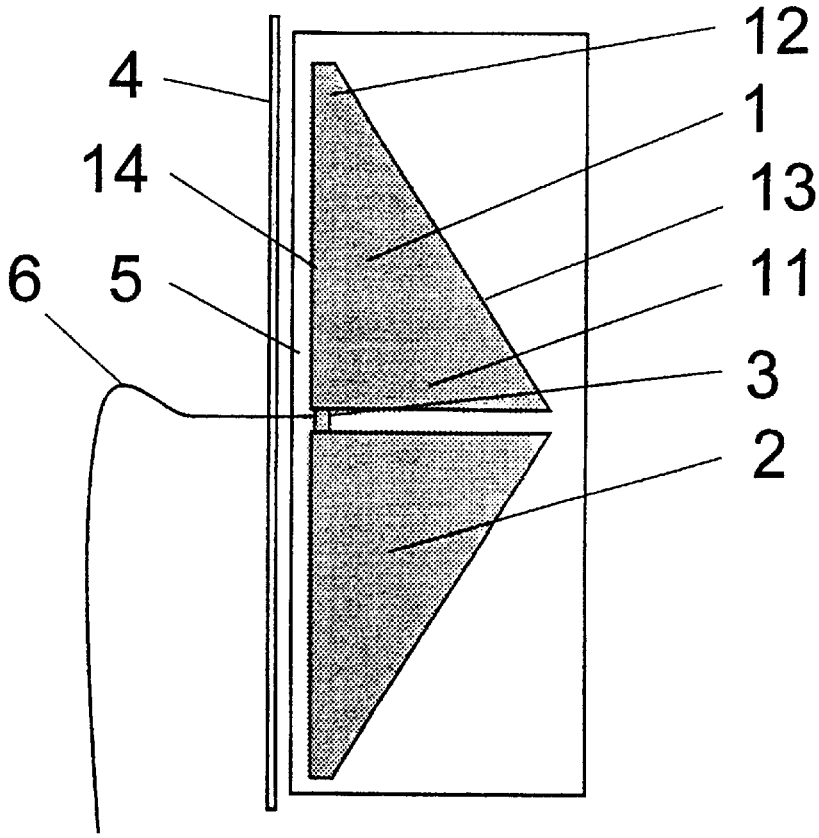

This application is the National Stage of International Application PCT/F100/00139 which was filed on Feb. 22, 2000 and designated the U.S. This International Application was published under PCT Article 21(2) in English.

The present invention relates to an antenna radiator consisting of two plate-like or film-like parts connected by their foot ends to each other and also to the supply connection of the antenna.

For instance, the base transceiver stations of mobile telephone systems use dipole antenna systems comprising dipole antennas adapted for one or more frequency ranges, e.g. 900 MHz and 1800 MHz. The antennas have relatively narrow radiators which consist of two parts extending to both sides of the supply point of the antenna. The antennas have been made e.g. by etching on a fiberglass circuit plate. The radiators of the antennas are relatively narrow.

Due to the high frequencies used in mobile telephone systems, the circuit plate on which the antenna construction has been etched causes dissipation. The dissipation is mainly due to a large current flowing at the foot of the radiator parts and to voltage losses occurring at the tips of the radiator parts. A drawback with present antennas is the magnitude of dissipation, which is a result of especially the fact that the radiator parts are narrow at the foot.

The object of the present invention is to eliminate the drawbacks of prior-art solutions and achieve a radiator structure especially applicable for use in base stations of mobile telephone systems. The antenna radiator of the invention is characterized in that, especially to reduce current and voltages losses, the radiator parts are substantially wider at the foot than at the tip.

An embodiment of the invention is characterized in that the radiator parts taper from the foot towards the tip.

When a radiator according to the invention is used, dissipation caused by the circuit plate is reduced because the wide foot part reduces the losses due to the current flowing in the foot. In addition, due to their narrow shape, the tips have a small contact area, thus producing only small voltage losses. Therefore, a good radiation efficiency is achieved.

In the following, the invention will be described in detail by the aid of an example with reference to the attached drawing, which presents an antenna with a radiator according to the invention, suited for use e.g. in a base transceiver station of the 900 MHz mobile telephone network.

The dipole antenna presented in the figure comprises a film-like dipole radiator of electrically conductive material, consisting of two parts, an upper and a lower part 1, 2. The parts are connected together by a narrow metal strip 3. Placed behind the radiator 1, 2 is a reflector 4, whose length somewhat exceeds the height of the radiator. The radiator 1, 2 and the strip 3 have been etched on a fiberglass circuit plate 5. The antenna is connected by a connecting cable 6 from the supply point at the middle of the strip 3 to the receiver-transmitter apparatus of a base transceiver station.

The radiator parts 1, 2 are of a triangular shape and symmetric with respect to each other so that the upper triangle points upward and the lower triangle 2 downward. Thus, each part 1, 2 tapers linearly from the foot end 11 towards the tip 12. The side 13 in the direction of the main beam is inclined while the side 14 next to the reflector 4 is upright.

In the radiator of the invention, the current density is significantly smaller than in prior-art solutions, especially at the foot 11 of the radiator parts 1, 2, where the current is largest, thanks to the width of the foot end structure. As the current is diminished toward the tip, the radiator part 1 tapers linearly, so that the tip 12 of the radiator, which is the most sensitive area of the radiator in respect of the operation of the antenna, is narrow. In addition, the tip 12 has a blunt shape to avoid interference.

It is obvious to a person skilled in the art that different embodiments of the invention are not restricted to the example described above, but that they may be varied within the scope of the claims presented below.

What is claimed is:

1. A dipole antenna radiator comprising:

two plate-like or film-like radiator parts connected by their foot ends to each other and to a supply connection of an antenna, the radiator parts being substantially wider at their foot ends than at their tips, wherein an edge of the radiator part on a side facing in a direction of radiation is straight while an edge opposite the direction of radiation is inclined, or wherein the edge of the radiator part on the side facing in the direction of radiation is inclined while the edge opposite to the direction of radiation is straight.

2. The dipole antenna radiator of claim 1, wherein the radiator parts are tapered from their foot end toward their tip.

3. The dipole antenna radiator of claim 2, wherein the radiator parts are tapered substantially linearly from their foot end toward their tip.

4. The dipole antenna radiator of claim 1, wherein the radiator parts are connected to each other via a narrow strip-like connecting part, the supply connection of the antenna being fitted in conjunction with the narrow strip-like connecting part.

5. The dipole antenna radiator of claim 1, wherein the radiator is fitted on a circuit plate.

* * * * *